United States Patent [19]

Correnti

[11] Patent Number: 4,872,715

[45] Date of Patent: Oct. 10, 1989

[54] SLIDING DOOR AND LOCK COMBINATION

[76] Inventor: Frank Correnti, 1740 SW. 10th St., Boca Raton, Fla. 33486

[21] Appl. No.: 247,491

[22] Filed: Sep. 22, 1988

Related U.S. Application Data

[63] Continuation-in-part of Ser. No. 142,648, Jan. 11, 1988, abandoned.

[51] Int. Cl.[4] ..... E05C 1/04

[52] U.S. Cl. ..... 292/302; 292/DIG. 46

[58] Field of Search ..... 292/302, DIG. 46, DIG. 33, 292/DIG. 20, DIG. 71, 150, 283, 295, 292; 49/449; 70/97, 65; 411/513-515

[56] References Cited

U.S. PATENT DOCUMENTS

| | | | |
|---|---|---|---|
| 270,410 | 1/1883 | Fox | 411/515 X |
| 1,336,505 | 4/1920 | Buggeln | 292/1 |
| 1,379,227 | 5/1921 | Stermer | 292/300 |
| 1,659,822 | 2/1928 | Innes | 292/302 |
| 2,194,763 | 3/1940 | Mayer . | |
| 2,266,689 | 12/1941 | Lemison | 411/515 |
| 2,488,688 | 11/1949 | Simmons . | |
| 3,460,861 | 8/1969 | Niilola | 292/281 |
| 3,711,894 | 1/1973 | Walters . | |
| 4,015,868 | 4/1977 | Buttler | 292/302 |
| 4,170,885 | 10/1979 | Lundgren | 49/449 X |
| 4,268,074 | 5/1981 | Alexander | 292/DIG. 20 X |
| 4,530,531 | 7/1985 | Mantini | 292/302 |
| 4,532,743 | 8/1985 | Miller et al. | 49/449 X |
| 4,627,657 | 12/1986 | Grimbly | 292/288 |

FOREIGN PATENT DOCUMENTS

| | | | |
|---|---|---|---|
| 734717 | 5/1966 | Canada | 49/449 |
| 40751 | 8/1932 | France | 292/302 |
| 408064 | 12/1944 | Italy | 292/302 |
| 3531 | of 1880 | United Kingdom | 49/449 |

*Primary Examiner*—Gary L. Smith
*Assistant Examiner*—Michael J. Milano
*Attorney, Agent, or Firm*—Victor F. Volk

[57] ABSTRACT

A pair of sliding doors is secured against intrusion by angles that fix the closed doors to a frame and by intermeshing plates that fix the centers of the doors together. The angles and plates terminate in intermeshing tubular portions that are locked together by means of vertical pins.

5 Claims, 3 Drawing Sheets

34
36
38
39
41
42
43
44
46
47
48
49
51
52
53
54
56
57
58
59
61
62
63
64
66
67
68
69
71
72
74
76
77
78
79
a

SLIDING DOOR AND LOCK COMBINATION

This application is a continuation-in-part of application Ser. No. 142,648, filed Jan. 11, 1988, now abandoned.

BACKGROUND OF THE INVENTION

Glass panelled sliding doors that open onto patios and gardens have become highly standardized, particularly those having aluminum frames. Each of the panels has a lengthwise bottom slot with imbedded rollers that ride upon one of two parallel tracks which fit into the slots. A prefabricated frame is installed in an opening in the building wall and this frame provides vertical recesses into which the ends of the panels are inserted when the doors are closed, providing air seals and making it difficult to insert a jimmy to pry a panel open. The standard door asseblies also provide catches that lock the closed panels to the frame, but these catches are somewhat fragile and can be readily circumvented by prying a panel upward off its track and pushing it inward.

Mantini U.S. Pat. No. 4,530,531 was cited by the Office in the parent to this case but Mantini's structure is far removed from the structure of the present invention and constitutes a relatively unsightly and much more inconvenient door locking means. Save for having the purpose of locking a sliding door Mantini is in no way suggestive of the invention to be described.

Innes U.S. Pat. No. 1,659,822 has also been cited. Innes employs the two plates of a door hinge to lock a hanging window sash to its sill. In particular, Innes plate hinges would not be useful where the sash fits into a recess formed by projecting strips, as shall be explained to be the case with sliding doors.

SUMMARY OF THE INVENTION

I have invented a combination of a sliding door and lock that comprises a building wall with a rectangular opening with a door frame fitted into it. The frame comprises left and right vertical frame members each of which has vertical strips projecting inwardly to define a panel-receiving recess. The frame also includes parallel inner and outer track means.

My combination also comprises inner and outer sliding-door panels each with mid-door and edge-door end posts. These panels are mounted on the tracks so that they can slide one behind the other. To lock my panels I provide angles which have one leg terminating in a tubular portion and the other leg pierced by screw holes for attachment. One of these angles is mounted to an end post of the outer panel and another angle is mounted to one of the vertical frame members between two of the vertical strips in such a manner that the tubular portions are aligned to accept a locking pin included in my invention. The inner panel is locked at the other vertical frame member by two cooperating angles except that an angle is here attached to the wall at a position inside of the innermost of the vertical strips.

I find it advantageous to lock the panels at their mid-door end posts by means of two plates that terminate in tubular portions at one end and also include screw attachment holes. One of the plates is attached to the edge of the mid-door end post of the inner panel so that it is normal to the plane of the panel and the other plate is attached to the mid-door end post of the outer panel between the two end posts and parallel to the plane of the panels. Openings in a vertical lip of the post of the outer panel permit the plate to be screwed on. Here, too, the tubular portions are aligned to accept my locking pin.

DETAILED DESCRIPTION OF PREFERRED EMBODIMENT

Figure 1:
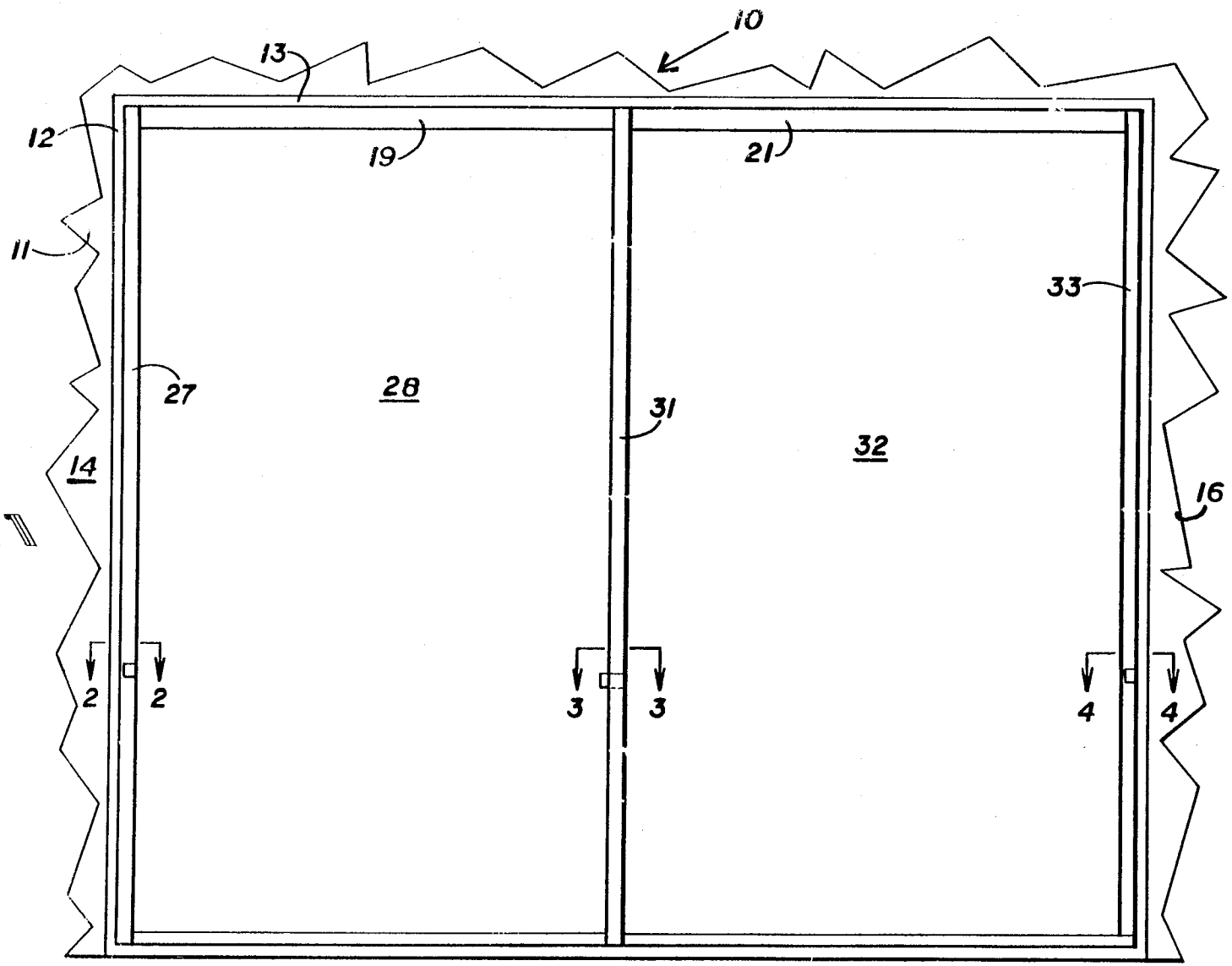
FIG. 1 is an elevation of the sliding door and lock combination viewed from inside.
Figure 4:
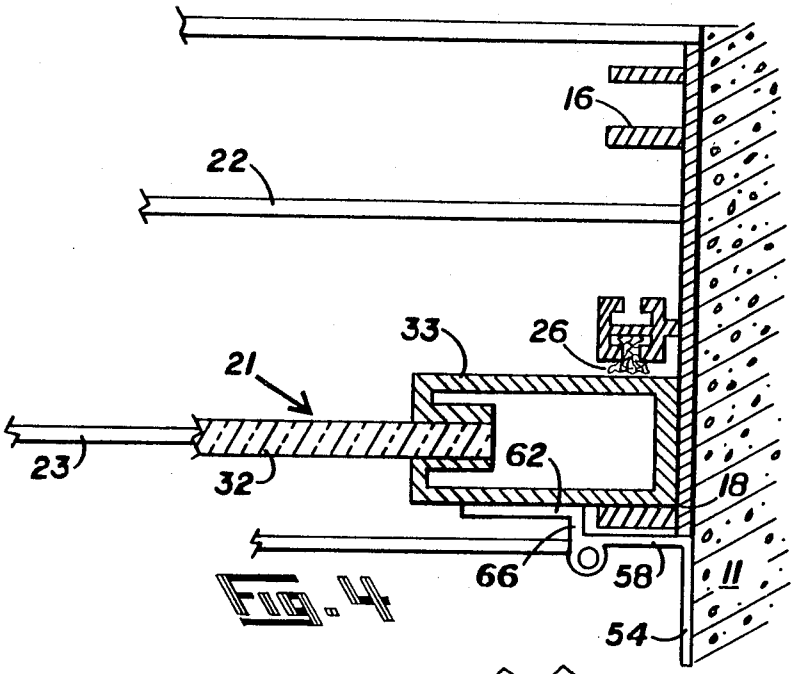
FIG. 4 is an enlarged section through the line 4—4 of FIG. 1.
Figure 1B:
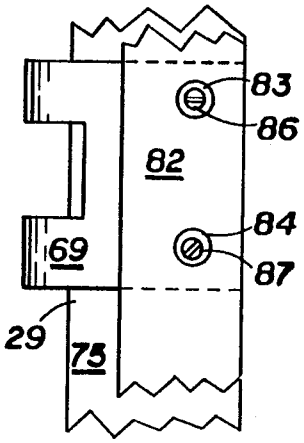
Figure 2:
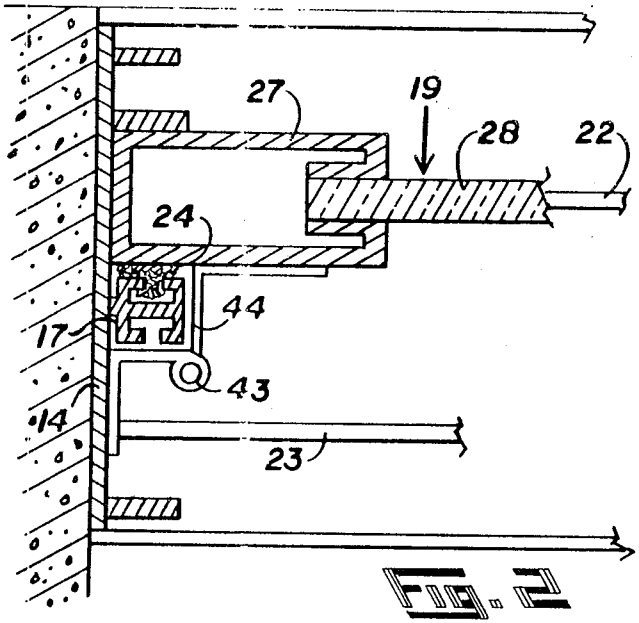
FIG. 2 is an enlarged section through the line 2—2 of FIG. 1.
Figure 3:
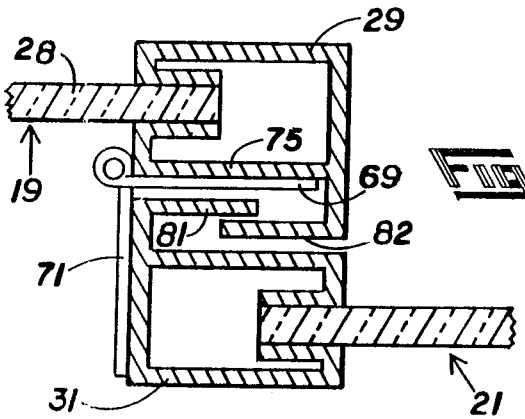
FIG. 3 is an enlarged section through the line 3—3 of FIG. 1.

Referring first to FIG. 1 my sliding-door and lock combination 10 is seen to comprise a building wall 11 with an opening 12 fitted by a metal frame 13 comprising a left vertical member 14 and right vertical member 16 from which there inwardly project the respective vertical strips 17 (FIG. 2) and 18 (see also FIG. 4). These strips help define recesses for the edges of a left, outside panel 19 and right, inside panel 21 which ride on respective tracks 22 and 23 (FIGS. 2 and 4). The strips 17 and 18 present obstacles to efforts to lock the panels to the frame and particularly the strip 17 presents such an obstacle due to its width which is necessitated by the presence of grooves to hold felt sealing strips 24, 26. An edge-door end post 27 of the panel 19 supports a glass plate 28 which is also supported by a mid-door end post 29 (FIG. 3). The glass is centered in the post 27 but is eccentrically fit into the post 29 to provide close clearance between the post 29 and another mid-door post 31 on the panel 21 which supports another glass plate 32. The right end of the glass plate 32 is symmetrically supported by an edge-door post 33.

Figures 5, 6, 7, 8, 9, 10, 11, 12, 13, 14, 15, 16, 17, 18:
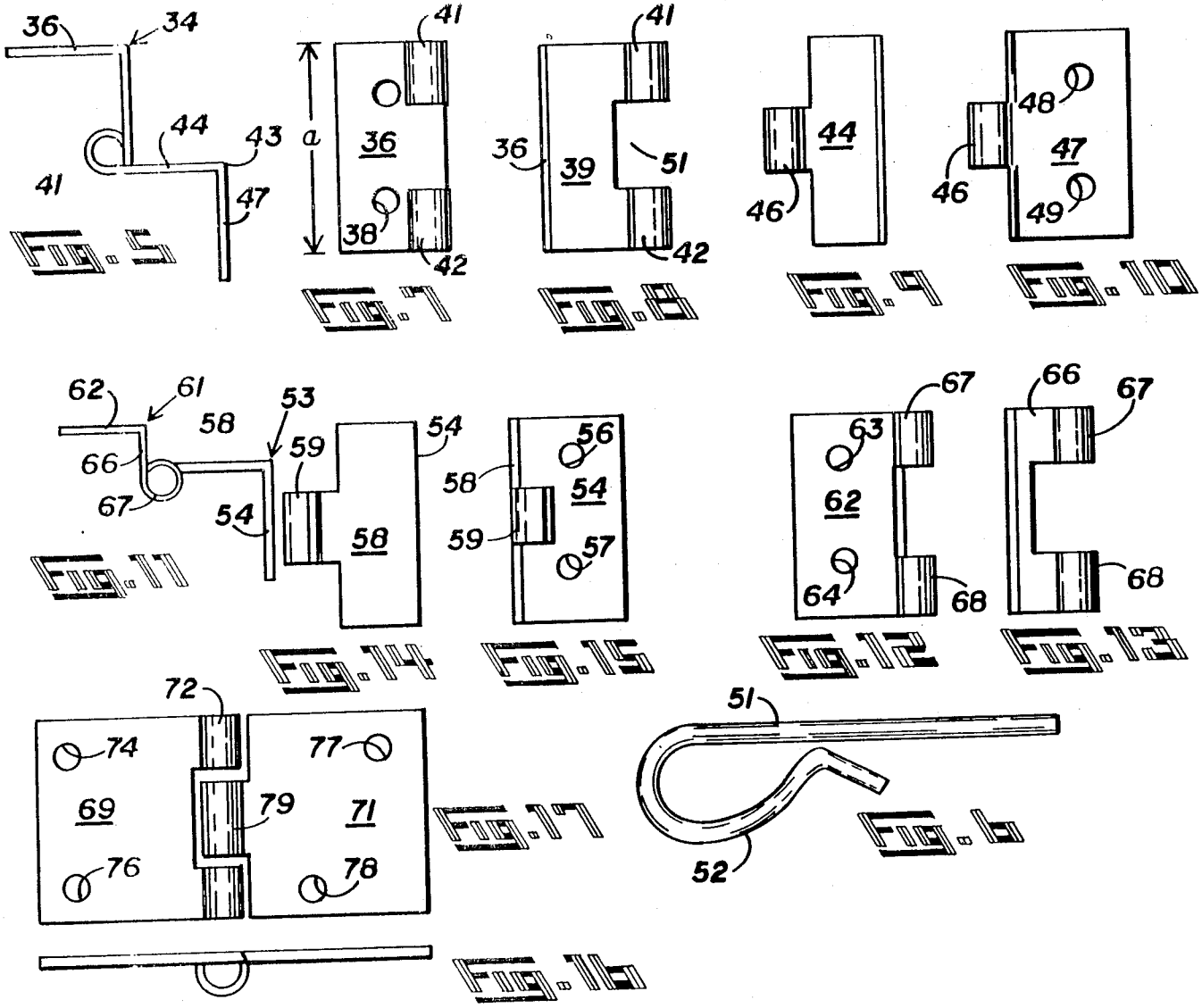
FIG. 5 is a top view of the pair of angles for end attachment to the outer panel of my combination.
FIG. 6 is a side view of the pin of my invention.
FIG. 7 is a front view of the left angle of FIG. 5.
FIG. 8 is a side view of the angle of FIG. 7.
FIG. 9 is a front view of the right positioned angle of FIG. 5.
FIG. 10 is a side view of the angle of FIG. 10.
FIG. 11 is a top view of the pair of angles for end attachment to the inner panel of my combination.
FIG. 12 is a front view of the left angle of FIG. 11.
FIG. 13 is a side view of the angle of FIG. 12.
FIG. 14 is a front view of the right positioned angle of FIG. 11.
FIG. 15 is a side view of the angle of FIG. 14.
FIG. 16 is a top view of a pair of plates of my combination.
FIG. 17 is a front view of the plates of FIG. 16.
FIG. 18 is a front view of a portion of the post 29 with the panels open.

Referring now to FIGS. 5–17 we are shown steel (or other suitably strong) locking elements which are uniquely capable of locking the panels 19 and 21 to each other and to the frame 13 and wall 11. An angle 19 and 21 to each other and to the frame 13 and wall 11. An angle 34 comprises a leg 36 with two screw holes 37, 38 and a leg 39 which is rolled at one end to form aligned tubular portions 41, 42. An associated angle 43 comprises a leg 44 with a tubular portion 46 and a leg 47 with holes 48 and 49. A gap 51 between the tubular portions 41 and 42 is wider than the tubular portion 46 by about ⅛ inch (3.2 mm) to preclude any problem in meshing the two when the doors are closed, yet not allow enough play to raise a door off its track. When the tubular portions 41, 42 are aligned with the tubular portion 46 they can be locked together by insertion of a pin 51 (FIG. 6). A turned back portion 52 of this pin provides inexpensive hand-gripping means for inserting or removing the pin. The angles of FIGS. 5–10 are particularly suited to fasten the post 27 of the rear panel 19 to the vertical member 13 (FIG. 3) since the width of the leg 44 will clear the thickness of the strip 17.

Referring back to FIG. 11, an angle 53 comprises a leg 54 with screw holes 56, 57 and a leg 58 with a tubular portion 59 and an angle 61 comprises a leg 62 with holes 63 and 64 and a leg 66 with two aligned tubular portions 67, 68. The width of the leg 66 is relatively shallow since it has only to clear the thickness of the strip 18 (FIG. 4) when the leg 54 is fastened to the wall 11 or frame 13.

Plates 69, 71 of FIGS. 16 and 17 are used to lock the posts 29, 31 of the panels to each other as shown in FIG. 3. The plate 69 has tubular portions 72, 73 turned back to be entirely on one face of the plate so that when the plate is attached to a front surface 75 of the post 29 the tubular portions do not interfere with movement of the facing post 31. The plate 69 comprises screw holes 74, 76 remote from the tubular portions. Since stresses on screws through these holes will be in shear no loss in strength results from having them clear the end of the glass plate 28; in addition the holes 74, 78 must clear a lip 81 of the post 31. The post 29 comprises a vertical lip 82 parallel to its surface 75 and a lip 81 of the post 31 intermeshes with the lip 82 to produce a positive closure between the two panels, which are usually made airtight by vertical weatherproofing, not shown. When the plate 69 is screwed onto the surface 75 it covers and compresses a short extent of any weatherproofing. Two holes 83, 84 (FIG. 18) are drilled through the lip 82 so that a screw driver or such can be used to drive attachment screws 86, 87, similar to the screws (not shown) used to attach the other plate and the angles, through the holes 74, 76 in the plate 69 and into the surface 75. The plate 69, being, preferably, steel, is thin enough so that it does not prevent the lips 81, 82 from intermeshing. The plate 71 comprises screw holes 77, 78, diagonally spaced to clear the glass plate 32 and provide strength against a high bending moment for the plate 71 the screws of which will be stressed in tension when the plate is attached to the post 31 normal to the plane of the panel. The plates 69, 71 are so mounted that a tubular portion 79 of the plate 71 is aligned between the portions 72, 73 when the panels are closed, and one of the pins 51 can be passed through them. The angles and plates of my combination are inconspicuous and not unsightly, the length "a" of FIG. 7 being only about 1½ inches (31.1 mm) and I recommend that they be attached about 2 feet (0.61 m) above floor level.

The foregoing description has been exemplary rather than definitive of my invention for which I desire an award of Letters Patent as defined in the appended claims.

I claim:

1. A sliding-door and lock combination comprising:

(A) a building wall defining a rectangular opening, a frame fitting said opening, said frame comprising left and right vertical frame members each comprising vertical strips projecting inwardly therefrom to define a panel receiving recess and said frame also comprising parallel inner and outer track means, (B) inner and outer sliding-door panels each comprising mid-door and edge-door end posts, said panels being mounted on said tracks to slide one behind the other, (C) a first pair of angles and locking pin locking the outer of said panels to one of said vertical frame members, one leg of each of said angles terminating in a tubular portion and the other leg comprising walls defining screw attachment holes, one of said angles being attached to an edge-door end post of said outer panel and the other of said angles being attached to one of said vertical frame members between two of said strips, said tubular portions of said angles aligning to accept said pin, said outer panel being closed, (D) a second pair of angles and locking pin locking the inner of said panels at the other of said vertical frame members, one leg of each of said angles of said second pair of angles terminating in a tubular portion and the other leg defining screw attachment holes, one of said second pair of angles being attached to an edge-door end post of said inner panel and the other of said second pair of angles being attached to said wall at a point inside the innermost of said strips, said tubular portions of the angles of said second pair of angles aligning to accept said second pin, said inner panel being closed.

2. The sliding door and lock combination of claim 1 comprising a pair of plates and third locking pin, said plates each terminating in tubular portions at one end and comprising walls defining screw attachment holes, one of said plates being attached to said mid-door end post of said inner panel, normal to the plane thereof, and the other of said plates being attached to said mid-door end post of said outer panel, parallel to the plane thereof, said tubular portions of said plates aligning to accept said third pin, said panels being closed.

3. The sliding door and lock combinations of claim 1 wherein said tubular portions comprise spaced-apart lengths of said portions for one member of each of said pairs and a single length of said portions for the other member, said single lengths each fitting between said spaced-apart lengths.

4. The sliding door and lock combination of claim 2 wherein said tubular portions comprise spaced-apart lengths of said portions for one member of each of said pairs and a single length of said portions for the other member, said single lengths each fitting between said spaced-apart lengths.

5. The sliding door and lock combination of claim 2 wherein said post of said outer panel comprises a vertical lip, said lip comprising walls defining two openings in alignment with said attachment holes, whereby screwing means may be inserted through said lip to attach said plate to said end post of said outer panel.

* * * * *